United States Patent [19]

Fleissner

[11] Patent Number: 4,812,284

[45] Date of Patent: Mar. 14, 1989

[54] PROCESS FOR HEAT TREATMENT OF NONWOVENS

[75] Inventor: Gerold Fleissner, Chur, Switzerland

[73] Assignee: Fleissner GmbH & Co., Egelsbach, Fed. Rep. of Germany

[21] Appl. No.: 933,162

[22] Filed: Nov. 21, 1986

Related U.S. Application Data

[63] Continuation of Ser. No. 654,178, Sep. 25, 1984, abandoned.

[30] Foreign Application Priority Data

Sep. 26, 1983 [DE] Fed. Rep. of Germany ..... 3334787

[51] Int. Cl.[4] ..... D04H 1/54

[52] U.S. Cl. ..... 264/555; 264/571; 264/119; 264/123; 264/257; 264/284; 156/285; 156/209; 156/308.2; 156/324

[58] Field of Search ..... 264/555, 571, 572, 518, 264/119, 123, 257, 284; 156/285, 209, 308.2, 324

[56] References Cited

U.S. PATENT DOCUMENTS 3,201,499 8/1965 Cassé ..... 264/518
3,811,988 5/1974 Fleissner ..... 156/498

FOREIGN PATENT DOCUMENTS 2803379 9/1928 Fed. Rep. of Germany ..... 264/571

*Primary Examiner*—Jan H. Silbaugh
*Assistant Examiner*—Hubert C. Lorin
*Attorney, Agent, or Firm*—Antonelli, Terry & Wands

[57] ABSTRACT

The process serves essentially for the thermal bonding of lightweight nonwovens. For this purpose, the nonwoven is heated up by means of air penetration on a sieve drum of a flow dryer to a high percentage of the bonding temperature, and immediately thereafter is embossed with internally heated rolls in the squeeze roll nip of a calender. The apparatus provided for conducting the process consists of a sieve drum device wherein the embossing calender is arranged.

4 Claims, 1 Drawing Sheet

PROCESS FOR HEAT TREATMENT OF NONWOVENS

Figure 1:
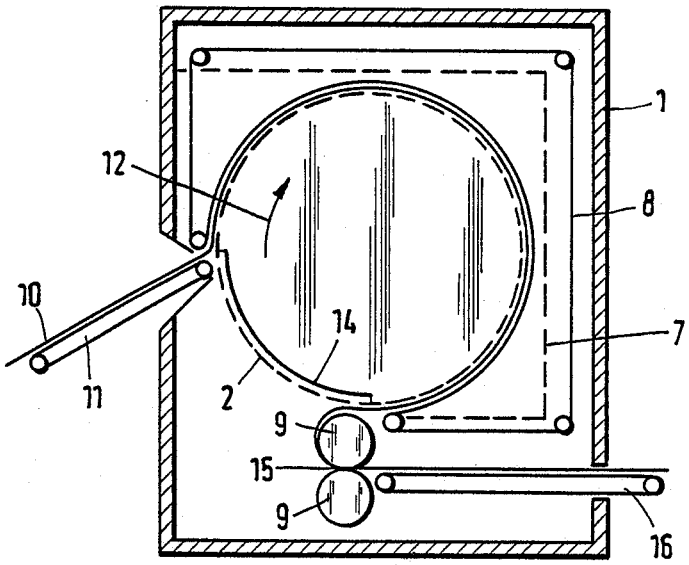

This is a continuation of application Ser. No. 654,178, filed Sept. 25, 1984, now abandoned.

This invention relates to a process for the heat treatment of nonwovens, i.e. nonwoven textile materials which contain, for bonding purposes, fusible fibers, bicomponent fibers, or other thermoplastic fibers, wherein the nonwoven is transported through a heated-up pair of pressure rolls, and to an apparatus for conducting the process. The typical fibers are Polyathylen, Polypropylen, Copolyester and so on.

The weights per unit area of, for example, carded webs range from 12 to 600 g per $m^2$. In order for the nonwovens of the aforementioned type to exhibit adequate strength in practical usage, it is necessary to subject the nonwovens to a heat treatment. It is conventional to apply this heat to the nonwoven product by means of calendering. In this process, the nonwoven material passes through the squeeze nip of a pair of pressure rolls consisting of internally heated cylinders. Since this heat treatment produces rigid nonwovens having a hard handle, it is known in connection with bulky nonwovens to heat the nonwoven on a sieve drum under a suction draft with a revolving endless belt to the necessary softening temperature of the thermoplastic fiber and to guide the nonwoven, subsequently to the heat treatment operation, through a cooled pair of pressure rolls with the objective of equalizing the nonwoven over its width and to freeze, i.e. set, the structure in place. According to DOS No. 1,660,791, the pair of chill rolls can also be followed by a cooling sieve drum for ventilating the nonwoven with cold air.

The treatment procedure according to the above-mentioned unexamined laid-open application has proven itself well for the treatment of voluminous nonwovens. In contrast thereto, the bonding method for lightweight nonwovens is today still restricted solely to calendering. Nonwovens having a weight per unit area of, for example, 12 g/$m^2$, are passed through a heated pair of pressure rolls optionally executing an embossing step at the same time. For this purpose, at least one roll of the calendar is to be equipped with profiling.

This calendering operation for the bonding of lightweight nonwovens has become popular in practice because lightweight nonwovens cannot be adequately pressed on the sieve drum. The delivery speed depends on the type of manufacture of the nonwovens, which include carded webs, spunbonded nonwovens, or also nonwovens produced by the wet fleece folding procedure. The delivery speeds, at present, are up to 200 m/min. The delivery speed of the respective nonwoven is of importance insofar as the pressing force in the pair of calender rolls must be higher with increasing delivery speed. It was found unfortunately that, with delivery speeds of above 100 m/min, the pressure in the pair of calender rolls must be set at such a high value, for obtaining fleece bonding, that the resultant product, even in case of lightweight nonwovens, has a hard final quality. In order to achieve adequate bonding of the nonwovens, the pressure force has in some cases been set so high that an additional cold molding of the fibers could be observed.

Furthermore, at high delivery speeds, the temperature of the rolls must be adjusted to be considerably higher than the value of the melt temperature of the fibers. This consequently leads quickly to damage to the material if the installation, for some reasons, happens to operate more slowly.

Starting with the process of the kind discussed above, the invention is based on the object of developing a procedure making it possible to bond and emboss, under the effect of heat, even lightweight nonwovens which are delivered at high speed, namely without having to expend excessively high pressure forces with rolls heated to an excessively high degree.

In order to attain this object, the invention provides that the nonwoven (in the form of a continuous length of material) is first heated at least to 70–80 % of the bonding temperature on a flow dryer, i.e. a sieve drum having a perforated sieve type conveying surface, on which it is retained during treatment by a suction draft and also exposed to a transverse throughflow of hot treatment gases (which enter into the interior of the drum), and the nonwoven runs immediately thereafter through the pair of pressure rolls, during which step it is subjected to uniform pressure over the operating width and is embossed while being heated. The pressure will be in the range of 1–20 kg/cm in the line of the pressure rolls. In the process of this invention, therefore, the embossing step is conducted by itself on a pair of pressure rolls while heating of the nonwoven is transferring from the pair of calender rolls to a flow dryer arranged directly upstream thereof. With the aid of this process, lightweight nonwovens can first be heated up to the required bonding temperature of 110°–270° C. on the sieve drum—the temperature depends of the plastic material —with a delivery speed of 200 m/min and more, and can then be brought to the desired configuration by the mere use of the pair of embossing rolls. In this way, only a low pressure of 1–20 kg/cm needs to be generated in the embossing roll pair for producing the desired pattern, so that the non-woven is automatically provided with a light, bulky handle. The embossing rolls may be heated or cooled, according to the thermoplastic material.

The apparatus for conducting the process consists at least of one heatable pair of pressure rolls, directly in front of which a sieve drum device is arranged. It is also possible in this connection to surround the sieve drum by an endless moving screen urging the nonwoven against the perforated surface of the sieve drum, namely the screen is arranged not for retaining the nonwoven on the sieve drum, but merely for preventing possible shrinkage of the nonwoven.

It should be stressed that the apparatus made up of sieve drum and pair of pressure rolls does not constitute two series-connected, individual units, but rather, based on the process of this invention, this entire apparatus represents a unitary component. The pair of pressure rolls, preferably to be arranged within the sieve drum device, i.e. within the housing thereof, so that the nonwoven heated up on the sieve drum has no opportunity to cool off before the embossing step takes place.

Figure 2:
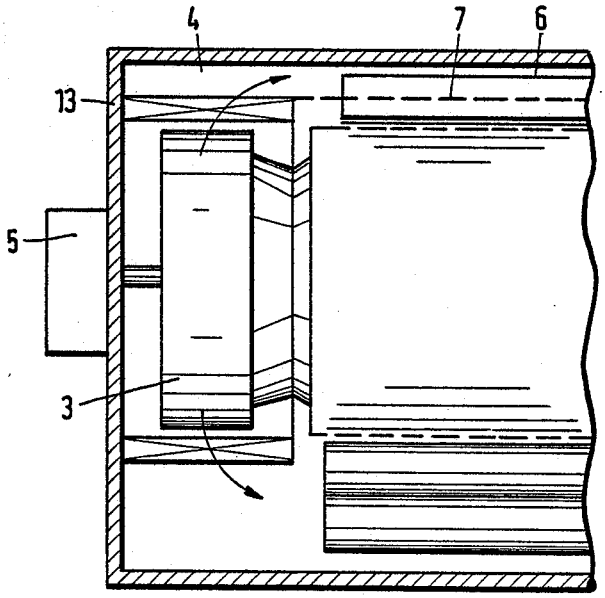

One embodiment of the apparatus of this invention is illustrated in the accompanying drawing wherein:

FIG. 1 shows, in cross section, a sieve drum device with a directly following pair of embossing rolls; and FIG. 2 shows the apparatus of FIG. 1 in a longitudinal section.

As shown in FIGS. 1 and 2, the sieve drum device of the present invention consists of a heat-insulated housing 1 wherein a sieve drum 2 is rotatably supported. The fan 3 is disposed, in a separate fan chamber 4, at one end face of the sieve drum 2, as can be seen from FIG. 2. This fan places the interior of the sieve drum 2 under a vacuum. The fan 3, driven by means of motor 5, blows the treatment air in the direction of the illustrated arrows in FIG. 2 on all sides around the sieve drum into the treatment chamber 6, which chamber is separated from the sieve drum 2 by a screen cover 7 in order to equalize the air flow. The sieve drum 2 as shown in FIG. 1 is surrounded by an endless moving belt screen 8 which urges the continuous length of nonwoven material 10 lying on the sieve drum against the drum to prevent shrinkage. However, in a less preferred embodiment the endless belt 8 can also be omitted. A pair of calender pressure rolls 9 is arranged immediately below the sieve drum 2 within the housing 1; the textile nonwoven material passes through the pair of rolls 9 of this installation. The pair of pressure rolls is constituted of internally heated cylinders and serves for embossing the nonwoven material 10 passing therethrough.

According to the illustration of FIG. 1, the nonwoven material 10 passes onto the surface of the sieve drum 2, penetrated by circulating air, by means of an endless moving belt 11 approximately at the level of the axis of the sieve drum, and is guided on account of the revolution direction 12 of the sieve drum upwardly around the sieve drum. A reversed direction of rotation of the sieve drum 2 and of the pair of pressure rolls in the zone of the inlet for the material is likewise possible. While being transported around the sieve drum, the nonwoven material 10 is subjected to a throughflow by the air heated with the heating device 13 (shown in FIG. 2) and thus is heated up. After traveling around the sieve drum 2 along an arcuate path of almost 270°, the suction draft at the surface of the drum is interrupted on account of the inner impermeable cover 14, and the nonwoven material will be detached or separated from the sieve drum and will pass around the top roll of the pair of pressure rolls 9, which rolls are also heated. Thereafter, the nonwoven passes through the nip 15 of the pressure rolls where it is squeezed and embossed with the desired surface. An endless moving screen 16 serving as the delivery element carries the finished nonwoven to a subsequent processing station.

I claim:

1. A process for the heat treatment of lightweight nonwoven textile materials containing, for bonding purposes, fusible fibers, bi-component fibers or other bondable thermoplastic fibers at high delivery speeds, which comprises feeding a continuous length of the nonwoven textile material to a sieve drum subjected to a suction draft within a housing at a feeding speed of between 100 and 500 m/min. or more; heating the nonwoven textile material up to at least 70–80% of the bonding temperature on the sieve drum, the nonwoven textile material being retained on the sieve drum during the heat treatment and also exposed to a temperature flow of hot treatment gases on said sieve drum; and passing the heated nonwoven textile material immediately thereafter through a pair of heated pressure rolls during which the nonwoven textile material is compressed uniformly at a pressure of 1–20 kg/cm over its operating width and embossed under heating to exhibit a light, bulky handle; said pressure rollers being located within the housing surrounding said sieve drum, the embossed nonwoven textile material being delivered from said housing via an opening in a wall of the housing and a continuous length of nonwoven textile material being introduced into the housing via another opening in a wall of the housing prior to being heated on said sieve drum, the nonwoven textile material fed to the sieve drum having a density of 5–50 g/m$^2$.

2. A process according to claim 1, wherein the nonwoven textile material has a density of 10–50 g/m$^2$.

3. A process according to claim 1, wherein the nonwoven textile material is guided about the sieve drum so that the nonwoven textile material is looped around the sieve drum along an arcuate path of about 270°.

4. A process according to claim 1, wherein the bonding temperature of the nonwoven textile material is from 110°–270° C.

* * * * *